US007261486B2

(12) United States Patent
Jian

(10) Patent No.: US 7,261,486 B2
(45) Date of Patent: Aug. 28, 2007

(54) CLEANING BRUSH

(76) Inventor: Sheng-Wen Jian, No. 38, Chaoliau Village, Daliau Shiang, Kaoshiung Hsien (TW)

( * ) Notice: Subject to any disclaimer, the term of this patent is extended or adjusted under 35 U.S.C. 154(b) by 0 days.

(21) Appl. No.: 11/463,645

(22) Filed: Aug. 10, 2006

(65) Prior Publication Data

US 2007/0041782 A1 Feb. 22, 2007

(30) Foreign Application Priority Data

Aug. 19, 2005 (TW) ..... 94214220 U

(51) Int. Cl.

| | |
|---|---|
| ***A46B 11/04*** | (2006.01) |
| ***A46B 11/06*** | (2006.01) |
| ***A46B 11/00*** | (2006.01) |
| ***A47K 7/02*** | (2006.01) |

(52) U.S. Cl. ..... 401/291; 401/290; 401/289; 15/209.1; 15/225

(58) Field of Classification Search ..... 401/268, 401/285, 289, 290, 291; 15/209.1, 211, 223, 15/225, 226; 300/5–8, 19, 20

See application file for complete search history.

(56) References Cited

U.S. PATENT DOCUMENTS 2,637,061 A * 5/1953 Ozdobinski ..... 15/226
3,924,288 A * 12/1975 Breland ..... 15/225
4,190,921 A * 3/1980 Rose ..... 15/225

OTHER PUBLICATIONS

Taiwan Utility Model Publication No. M245837, Oct. 11, 2004, 6 pages.

* cited by examiner

*Primary Examiner*—David J. Walczak
(74) *Attorney, Agent, or Firm*—Alan Kamrath; Kamrath & Associates PA

(57) ABSTRACT

A cleaning brush includes a rod, at least one cleaning cloth unit, and at least one plastic wire. The rod includes a passageway, a plurality of water outlets, and a water inlet. The passageway extends longitudinally in the rod and is in communication with the water inlet. The water outlets are defined in an outer circumference of the rod and in communication with the passageway. The water inlet is defined in an end of the rod. The cleaning cloth unit includes a cleaning cloth having opposite first and second sides. The cleaning cloth unit further includes a plastic core extending alternately between the first and second sides of the cleaning cloth. The plastic wire is wound around the plastic core to tightly tie the cleaning cloth unit to an outer circumference of the rod.

11 Claims, 6 Drawing Sheets

CLEANING BRUSH

BACKGROUND OF THE INVENTION

1. Field of the Invention

The present invention relates to a cleaning brush and more particularly, to a cleaning brush having at least one cleaning cloth unit effectively and reliably fixed to a rod, thereby providing enhanced cleaning effect and prolonged life.

2. Description of Related Art

Taiwan Utility Model Publication No. M245837 discloses a cleaning brush for wheels. The cleaning brush includes a body and two bristle members. A soft, anti-slip sleeve is mounted around the body. A coupler is mounted to a rear end of the body and includes an inner threaded section and a switch for controlling input of water into the body. A hollow rod from a front end of the body for outputting water or cleaning fluid. The hollow rod includes a longitudinal hole in communication with a water passageway in the body. A plurality of recessed portions are defined in an outer circumference of the hollow rod. Each recessed portion includes a plurality of water outlets at regular intervals. The front end wall of the body includes a plurality of insertion holes. The bristle members are fixed crosswise to the outer circumference of the hollow rod. Each bristle member includes a U-shaped frame and a plurality of bristles surrounding the U-shaped frame along the length of the U-shaped frame. Two ends of each U-shaped frame are inserted into the insertion holes of the body.

Such a cleaning brush can enter small gaps and clean dead corners. However, these bristle members are liable to disengage from the hollow rod, which adversely affects the cleaning effect and shortens the life of the cleaning brush.

OBJECT OF THE INVENTION

An object of the present invention is to provide a cleaning brush that has enhanced assembly reliability as well as enhanced convenience in use.

SUMMARY OF THE INVENTION

A cleaning brush in accordance with the present invention comprises a rod, at least one cleaning cloth unit, and at least one plastic wire. The rod includes a passageway, a plurality of water outlets, and a water inlet. The passageway extends longitudinally in the rod and is in communication with the water inlet. The water outlets are defined in an outer circumference of the rod and in communication with the passageway. The water inlet is defined in an end of the rod.

The cleaning cloth unit includes a cleaning cloth having opposite first and second sides. The cleaning cloth unit further includes a plastic core extending alternately between the first and second sides of the cleaning cloth. The plastic wire is wound around the plastic core to tightly tie the cleaning cloth unit to an outer circumference of the rod.

Preferably, a fixing cap is mounted to the other end of the rod that is distal to the water inlet, thereby clamping an end of the plastic core.

Preferably, a positioning sleeve is mounted around the rod and adjacent to the water outlets. The cleaning brush includes a plurality of cleaning cloth units, with each plastic core extending across the positioning sleeve to a position beyond the positioning sleeve. Another plastic wire is wound around distal ends of the plastic cores to clamp the distal ends of the plastic cores into a conic shape, thereby fixing the cleaning cloth units.

In an embodiment, the cleaning cloth units extend longitudinally in parallel on the outer circumference of the rod, and the plastic wire is wound around the plastic cores in a circumferential direction.

In another embodiment, the cleaning unit is wound continuously and helically around the outer circumference of the rod from the end of the rod through the other end of the rod in a first direction, and the plastic wire is wound continuously and helically around the plastic core from the end of the rod through the other end of the rod in a second direction opposite to the first direction.

Preferably, an anti-slip jacket is mounted around the positioning sleeve.

Preferably, the plastic wire is an iron wire.

Preferably, the cleaning cloth is made of polyvinyl alcohol.

The water outlets are spaced at regular or irregular intervals.

Preferably, the cleaning cloth is cut in two lateral sides into a plurality of strips spaced at regular intervals.

Other objects, advantages and novel features of this invention will become more apparent from the following detailed description when taken in conjunction with the accompanying drawings.

DETAILED DESCRIPTION OF THE PREFERRED EMBODIMENTS

Figure 1:
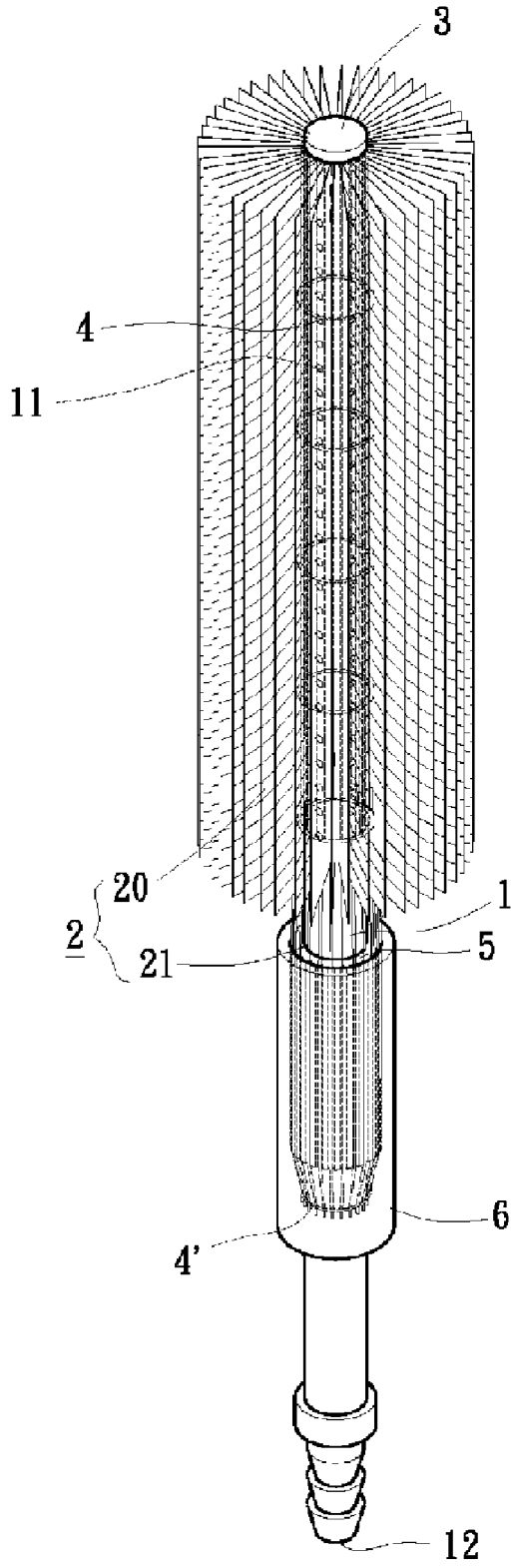
FIG. 1 is a perspective view of a first embodiment of a cleaning brush in accordance with the present invention.
Figure 2:
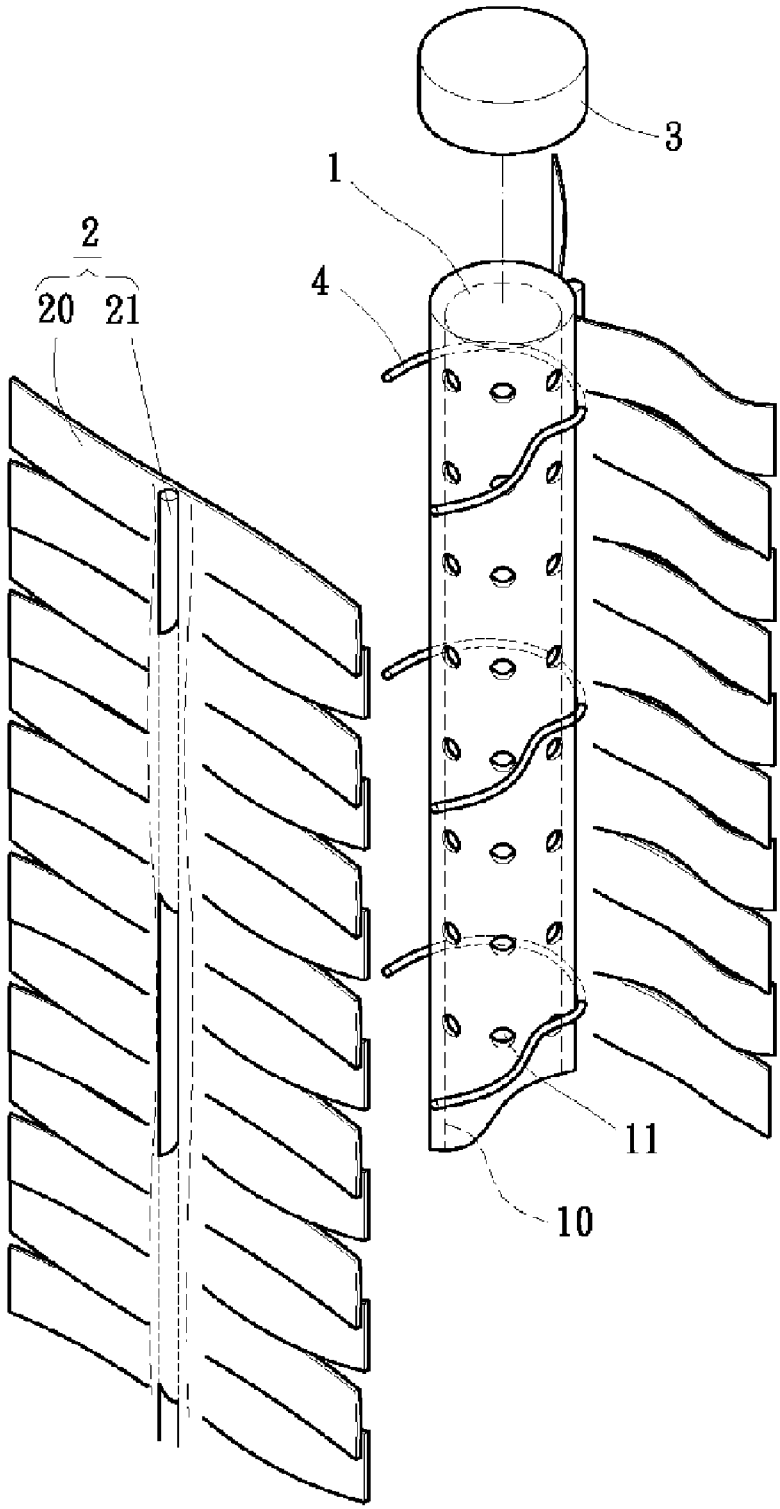
FIG. 2 is an exploded view of a portion of the first embodiment of the cleaning brush in accordance with the present invention.
Figure 3:
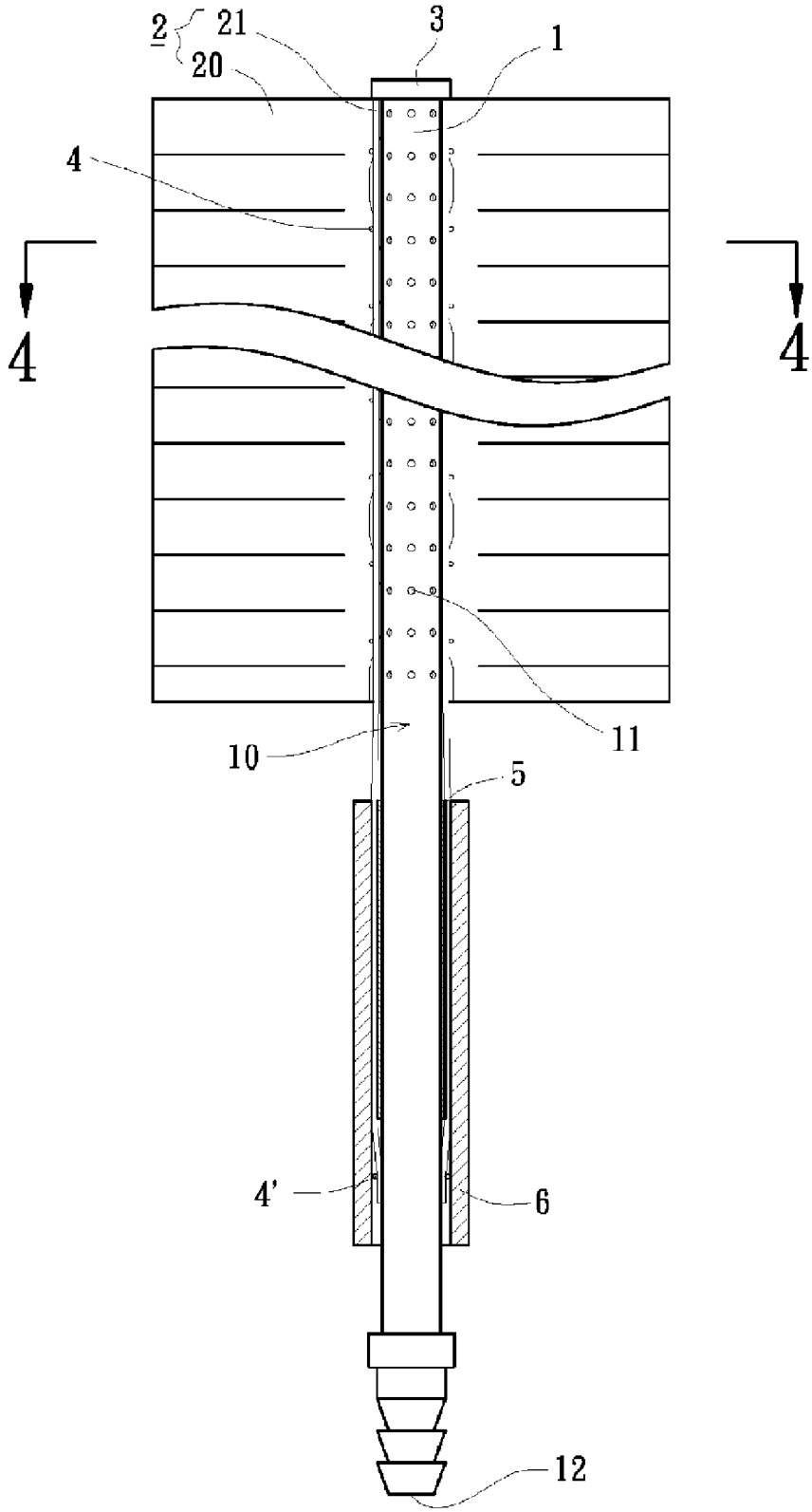
FIG. 3 is a sectional view of the first embodiment of the cleaning brush in accordance with the present invention.
Figure 4:
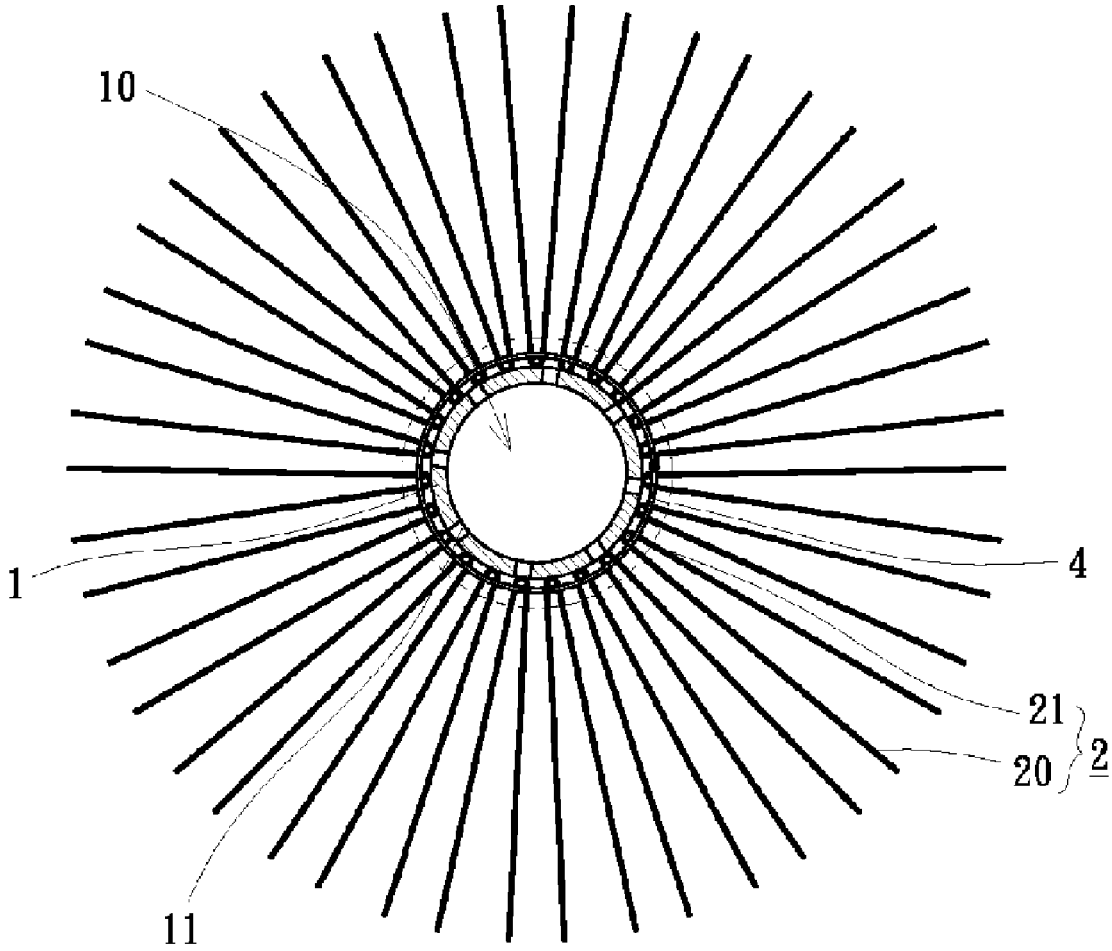
FIG. 4 is a sectional view taken along plane 4—4 in FIG. 3.

Referring to FIGS. 1 through 4, a first embodiment of a cleaning brush in accordance with the present invention comprises a rod 1, at least one cleaning cloth unit 2, a fixing cap 3, at least one plastic wire 4, a positioning sleeve 5, and an anti-slip jacket 6. The rod 1 includes a first end, a second end, a passageway 10, a plurality of water outlets 11, and a water inlet 12. The passageway 10 extends longitudinally in the rod 1 and is in communication with the water inlet 12. The water outlets 11 are defined in an outer circumference of the rod 1 and spaced at regular or irregular intervals. The water outlets 11 are in communication with the passageway 10. The water inlet 12 is defined in the first end of the rod 1 and coupled with a water supply device, such as a water pipe, thereby supplying water to the cleaning brush in use. The water inlet 12 may include an anti-slip coupler to provide reliable coupling.

Still referring to FIGS. 1 through 4, the cleaning cloth unit 2 in the first embodiment includes a cleaning cloth 20 and a plastic core 21. Polyvinyl alcohol (PVA) is one of the suitable materials for the cleaning cloth 20 for its porosity and large water-absorbing capacity. Preferably, each cleaning cloth 20 is cut in two lateral sides into a plurality of strips (not labeled, see FIG. 2) spaced at regular intervals to increase the contact area with an object to be cleaned, thereby enhancing the cleaning effect. Preferably, the plastic core 21 is a shapeable wire such as iron wire. The plastic core 21 extends along a central portion of the cleaning cloth 20. Further, the plastic core 21 extends alternately between first and second sides of the cleaning cloth 20, i.e., the plastic core 21 repeatedly extends from the first side through the second side of the cleaning cloth 20 and from the second side through the first side of the cleaning cloth 20 such that some sections are on the first side of the cleaning cloth 20 and the other sections are on the second side of the cleaning cloth 20. This prevents the cleaning cloth 20 from moving relative to or disengaging from the plastic core 21. Preferably, the length of the plastic core 21 extends to a position adjacent to the first end of the rod 1.

Still referring to FIGS. 1 through 4, the fixing cap 3 has an inner diameter slightly greater than an outer diameter of the rod 1 and fixed to the second end of the rod 1 for clamping an end of the plastic core 21 of the cleaning cloth unit 2. Preferably, the plastic wire 4 is a shapeable wire such as iron wire. The plastic wire 4 extends through the gaps among the strips of the cleaning cloth 2 and is wound around the plastic core 21. Thus, the cleaning cloth unit 2 is tightly tied to the outer circumference of the rod 1.

The positioning sleeve 5 is preferably made of a more rigid material and mounted around the rod 1 in a position adjacent to the first end of the rod 1. Preferably, the anti-slip jacket 6 is made of a soft material to provide the user with gripping comfort when in use. Preferably, the anti-slip jacket 6 is mounted around the positioning sleeve 5, and the distal end of the plastic core 21 is between the anti-slip jacket 6 and the positioning sleeve 5.

Still referring to FIGS. 1 through 4, in assembly of the first embodiment, the positioning sleeve 5 is mounted around the rod 1 in a position adjacent to the first end of the rod 1. There are a plurality of cleaning cloth units 2 in this embodiment. The respective plastic cores 21 alternately extend between first and second sides of the respective cleaning cloths 20 along the central portions of the respective cleaning cloths 20 to form the cleaning cloth units 2. Each cleaning cloth unit 2 is placed longitudinally on the outer circumference of the rod 1. Preferably, the length of each cleaning cloth unit 2 is about a half of that of the rod 1. Since each plastic core 21 tied to the rod 1 extends along the central portion of the associated cleaning cloth 20, each cleaning cloth 20 extends radially outward from the rod 1 in a substantially V-shape (see FIG. 4). At least one plastic wire 4 is wound around each cleaning cloth unit 2 in a circumferential direction and preferably extended through the gaps among the strips of the cleaning cloth 20 of each cleaning cloth unit 2. Each cleaning cloth unit 2 is thus tightly tied to the rod 1. The distal end of each plastic wire 21 extends across the positioning sleeve 5 to a position adjacent to the first end of the rod 1. Another plastic wire 4' is used and wound around the distal ends of the plastic wires 21, thereby clamping all of the plastic wires 21. Since a level difference exists between the positioning sleeve 5 and the rod 1, the distal ends of the plastic cores 21 are clamped by the plastic wire 4' into a conic shape. This allows the cleaning cloth units 2 to be reliably fixed to the rod 1. The fixing cap 3 is then mounted to the second end of the rod 1 and clamps the ends of the plastic cores 21. The anti-slip jacket 6 is mounted around the positioning sleeve 5. Thus, a cleaning brush with reliable assembly is provided.

Still referring to FIGS. 1 through 4, in use, a water supply device (such as a water pipe) is connected to the water inlet 12 of the rod 1 to provide water or cleaning fluid to the water outlet 11 through the passageway 10 of the rod 1 for cleaning purposes. Since the cleaning brush has reliable assembly, the cleaning effect and the utility convenience are both enhanced.

Figure 5:
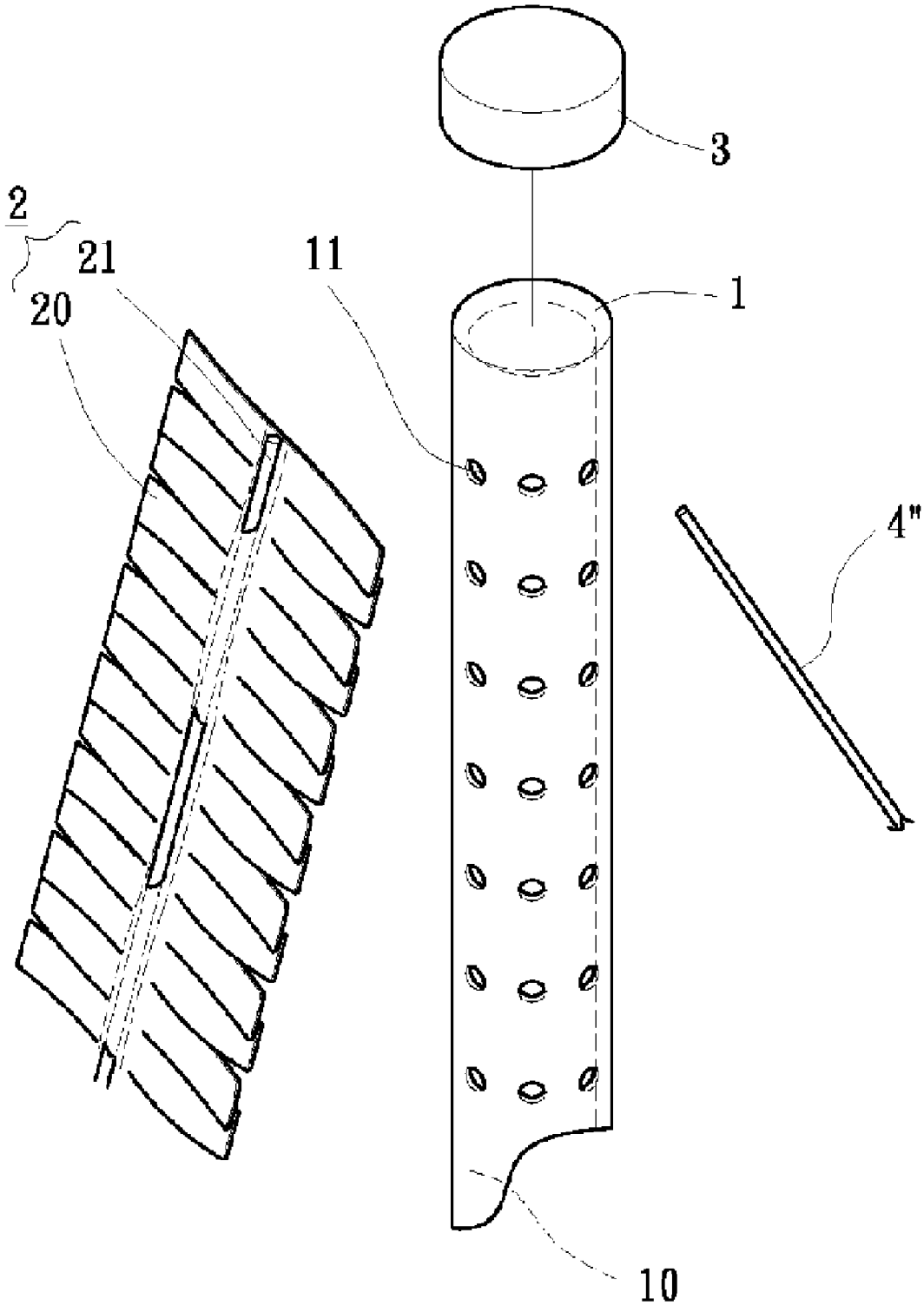
FIG. 5 is an exploded perspective view illustrating a portion of a second embodiment of the cleaning brush in accordance with the present invention.
Figure 6:
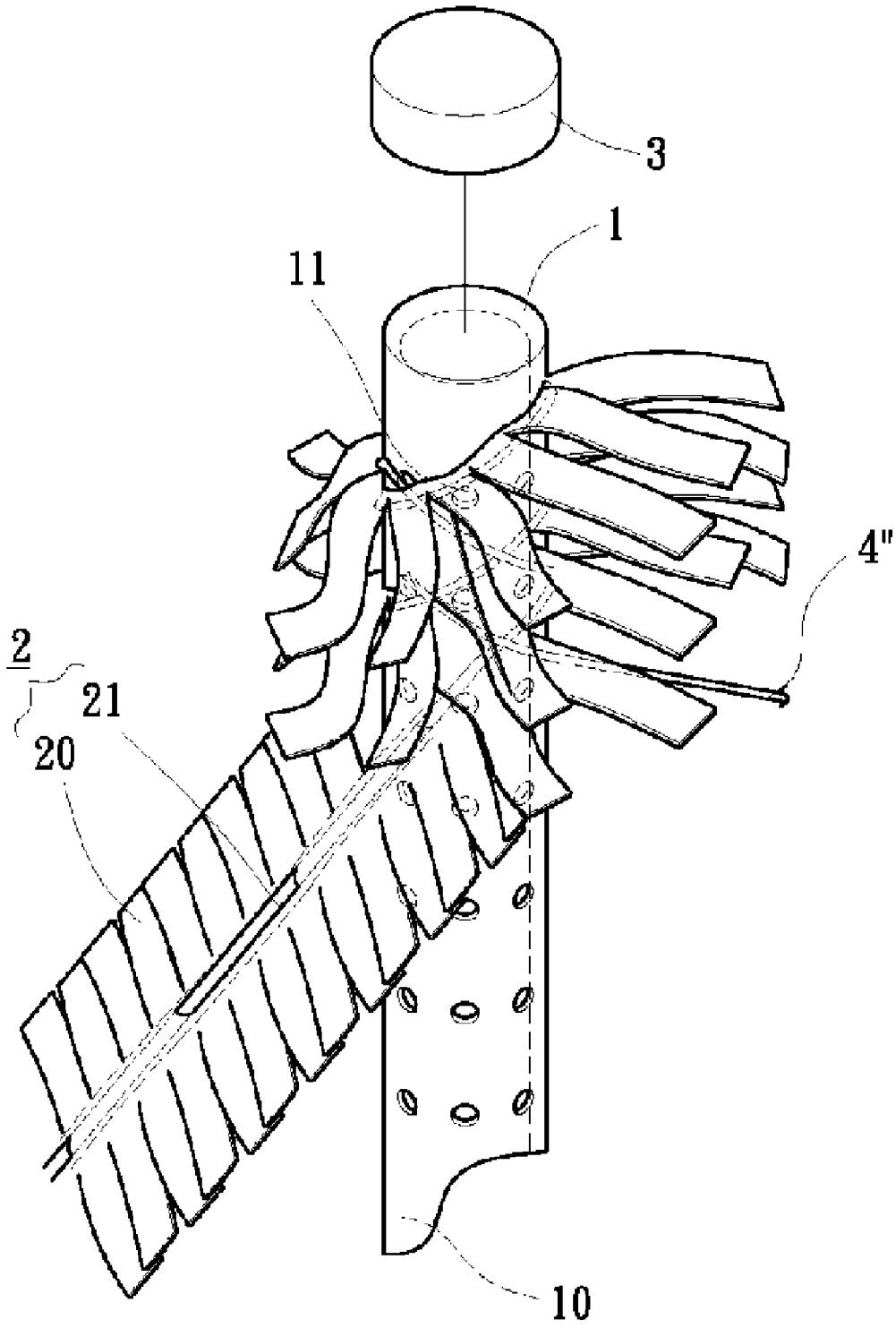
FIG. 6 is a partly exploded perspective view illustrating the portion of the second embodiment of the cleaning brush in accordance with the present invention.

FIGS. 5 and 6 illustrate a second embodiment of the cleaning brush in accordance with the present invention. In this embodiment, the cleaning brush comprises the rod 1, the cleaning cloth unit 2, the fixing cap 3, and a plastic wire 4". The cleaning cloth unit 2 is wound helically and continuously around the rod 1 from the second end of the rod 1 through the first end of the rod 1 in a direction whereas the plastic wire 4" is wound helically and continuously around the plastic core 21 of the cleaning cloth unit 2 from the second end of the rod 1 through the first end of the rod 1 in a direction opposite to the winding direction of the cleaning cloth unit 2 (see FIG. 6). The plastic wire 4" further extends to a position adjacent to the first end of the rod 1 to tightly tie the cleaning cloth unit 2 to the outer circumference of the rod 1. The fixing effect is reliable. The cleaning effect and the utility convenience are both enhanced. The positioning sleeve 5 and the anti-slip jacket 6 in the first embodiment can also be used in this embodiment.

By such an arrangement, the cleaning cloth unit(s) 2 can be reliably fixed to the rod 1. Thus, the cleaning cloth unit(s) 2 will not move relative to or disengage from the rod 1. The cleaning effect and the utility convenience are both enhanced.

While the principles of this invention have been disclosed in connection with specific embodiments, it should be understood by those skilled in the art that these descriptions are not intended to limit the scope of the invention, and that any modification and variation without departing the spirit of the invention is intended to be covered by the scope of this invention defined only by the appended claims.

What is claimed is:

1. A cleaning brush comprising:

a rod including a passageway, a plurality of water outlets, and a water inlet, the passageway extending longitudinally in the rod and being in communication with the water inlet, said water outlets being defined in an outer circumference of the rod and in communication with the passageway, the water inlet being defined in an end of the rod;

at least one cleaning cloth unit including a cleaning cloth having opposite first and second sides, said at least one cleaning cloth unit further including a plastic core extending alternately between the first and second sides of the cleaning cloth; and at least one plastic wire wound around the plastic core to tightly tie said at least one cleaning cloth unit to an outer circumference of the rod.

2. The cleaning brush as claimed in claim 1 further comprising a fixing cap mounted to another end of the rod that is distal to the water inlet, thereby clamping an end of the plastic core.

3. The cleaning brush as claimed in claim 1 further comprising a positioning sleeve mounted around the rod and adjacent to the water outlets, with each said plastic core extending across the positioning sleeve to a position beyond the positioning sleeve, further comprising another plastic wire wound around distal ends of said plastic cores to clamp the distal ends of the plastic cores into a conic shape, thereby fixing the cleaning cloth unit.

4. The cleaning brush as claimed in claim 3, wherein the cleaning cloth units extend longitudinally in parallel on the outer circumference of the rod, and wherein the plastic wire is wound around the plastic cores in a circumferential direction.

5. The cleaning brush as claimed in claim 3, wherein said at least one cleaning unit is wound continuously and helically around the outer circumference of the rod from the end of the rod through another end of the rod in a first direction, and wherein the plastic wire is wound continuously and helically around the plastic core from the end of the rod through said another end of the rod in a second direction opposite to the first direction.

6. The cleaning brush as claimed in claim 3 further comprising an anti-slip jacket mounted around the positioning sleeve.

7. The cleaning brush as claimed in claim 1, wherein said at least one plastic wire is an iron wire.

8. The cleaning brush as claimed in claim 1, wherein the cleaning cloth is made of polyvinyl alcohol.

9. The cleaning brush as claimed in claim 1, wherein the water outlets are spaced at regular intervals.

10. The cleaning brush as claimed in claim 1, wherein the water outlets are spaced at irregular intervals.

11. The cleaning brush as claimed in claim 1, wherein the cleaning cloth is cut in two lateral sides into a plurality of strips spaced at regular intervals.

* * * * *